US006352745B1

(12) United States Patent
Merovitz et al.

(10) Patent No.: US 6,352,745 B1
(45) Date of Patent: Mar. 5, 2002

(54) METHOD OF MAKING FRAGRANCED GLOVES

(75) Inventors: Gerald Merovitz, Dover, DE (US); Joseph Hourihan, Little Falls; Barbara Donovan, Wayne, both of NJ (US)

(73) Assignee: Playtex Products, Inc., Westport, CT (US)

( * ) Notice: Subject to any disclaimer, the term of this patent is extended or adjusted under 35 U.S.C. 154(b) by 0 days.

(21) Appl. No.: 09/428,592

(22) Filed: Oct. 27, 1999

(51) Int. Cl.[7] ..... B05D 3/12

(52) U.S. Cl. ..... 427/233; 427/236; 427/242; 427/424

(58) Field of Search ..... 427/230–233, 427/236–237, 242, 421, 424; 2/167, 168

(56) References Cited

U.S. PATENT DOCUMENTS

| | | | | |
|---|---|---|---|---|
| 2,501,565 | A | | 3/1950 | Halley |
| 2,916,036 | A | | 12/1959 | Sutton |
| 3,384,083 | A | | 5/1968 | Cozza et al. |
| 3,650,816 | A | * | 3/1972 | Rudy et al. |
| 3,896,807 | A | | 7/1975 | Buchalter |
| 3,942,193 | A | * | 3/1976 | Pugh |
| 3,992,221 | A | | 11/1976 | Homsy et al. |
| 4,185,330 | A | | 1/1980 | Stager |
| 4,597,108 | A | * | 7/1986 | Momose |
| 4,645,251 | A | | 2/1987 | Jacobs |
| 4,833,172 | A | | 5/1989 | Schwarz et al. |
| 4,853,978 | A | | 8/1989 | Stockum |
| 4,910,803 | A | | 3/1990 | Cukier |
| 5,335,373 | A | | 8/1994 | Dangman et al. |
| 5,357,636 | A | | 10/1994 | Dresdner, Jr. et al. |
| 5,458,588 | A | | 10/1995 | Amdur et al. |
| 5,740,551 | A | | 4/1998 | Walker |

FOREIGN PATENT DOCUMENTS

JP 61-276560 * 12/1986

OTHER PUBLICATIONS

Hawleys Condensed Chemical Dictionary, 13th Ed. p. 905, 1997.*

* cited by examiner

*Primary Examiner*—Fred J. Parker
(74) *Attorney, Agent, or Firm*—Ohlandt, Greeley, Ruggiero & Perle, LLP

(57) ABSTRACT

There are provided methods for making a fragranced glove. The first method comprises the steps of: providing a glove with an inside surface and an outside surface, applying a fragrance to the glove, tumbling the glove to evenly distribute the fragrance, and drying the glove to remove the residual fragrance. The second method comprises the steps of providing a cured glove having an inside surface and an outside surface placed in their proper positions; halogenating the glove; rinsing the halogenated glove in a rinse solution; drying the rinsed glove; and applying a fragrance on the glove. The third method comprises providing a cured glove having an inside surface and an outside surface; halogenating the glove; neutralizing the halogenated glove; rinsing the glove in a rinse solution after neutralizing; drying the rinsed glove; cooling the dried glove; applying a fragrance onto the dried glove; and, tumbling the glove to distribute evenly the fragrance.

21 Claims, 5 Drawing Sheets

METHOD OF MAKING FRAGRANCED GLOVES

BACKGROUND OF THE INVENTION

1. Field of the Invention

The present invention relates to rubber or latex gloves and, in particular, to a method of making same. More particularly, the present invention relates to a method of making a rubber or latex glove having a fragrance.

A rubber or latex glove is typically worn to cover a user's hand and, perhaps, arm. The glove provides protection or a physical barrier against water, detergents, and grease, especially when a user is engaged in cleaning activities, for instance, when washing dishes. It is desired that the glove be flexible to provide manual dexterity to the user. Also, each glove should be fitted properly so that it does not slide on the user's hand or permit unwanted material from entering into the glove.

Because of their barrier protection, rubber or latex gloves are typically used for tasks directed to cleaning or jobs that may be dirty or in which the hands and arms may require protection. However, when using rubber or latex gloves, the odor from the rubber or latex is very noticeable. Many individuals consider the odor to be undesirable and even somewhat objectionable.

In contrast, people generally enjoy fragrances and pleasant smells. In many situations, fragrances are used to mask or cover up objectionable odors. They can be used to distract or alter the experience one has when faced with an otherwise undesirable situation or task.

Consumer expectations must be fulfilled by the fragrance. This requires careful selection of the fragrance. Typically panel and consumer testing are performed to make the appropriate selection. Consideration is also given to the strength of the fragrance, which must be acceptable to the consumer. That is, the fragrance cannot be too strong or too weak, but must be adjusted to the proper level.

However, fragrances are expensive and must be used sparingly to keep down costs. The application of a fragrance onto a glove must be cost effective in order to avoid any unnecessary increase in the cost of the glove. Moreover, the amount of fragrance should be minimized again to avoid unnecessary increases in the cost of the glove.

2. Description of Related Art

Past attempts to incorporate a fragrance into a glove has involved adding fragrance into the latex or rubber compound. This can be an expensive proposition and an inefficient method of making such a glove. The latex or rubber must be in a liquid state. Adding fragrance to the compound, undesirably leads to fragrance volatilizing off during processing. As such, higher levels of fragrance must be added to compensate for the continual loss of fragrance. Even worse, the fragrance can be altered or destroyed by combining it with the latex or rubber.

When reviewing prior art patents, one does not learn how to effectively and efficiently apply fragrance onto a glove.

U.S. Pat. No. 3,942,193 entitled "Dental Glove" discloses a latex dental glove, where the glove body is covered in a liquid slurry. The liquid slurry contains a dusting powder, an adhesive agent, and a flavoring agent. The flavor agent imparts taste to the glove, making the presence of the glove in the mouth less objectionable. However, there is no suggestion to apply a fragrance to a glove.

U.S. Pat. No. 4,597,108 entitled "Powderfree Surgical Gloves" discloses methods for making a latex glove where the inside and outside of the glove are halogenated to impart a slippery surface to the glove. This patent does not teach how to add fragrance to the glove.

BRIEF SUMMARY OF THE INVENTION

It is an object of the present invention to provide a method for making a fragranced glove.

It is another object of the present invention to provide such a glove that has a pleasant odor that remains after the glove is used several times.

It is yet another object of the present invention to provide a method that uniformly applies fragrance to a glove.

It is a further object of the present invention to provide such a method that applies fragrance to the inside surface of the glove.

To accomplish the foregoing objects and advantages, the present invention, in brief summary, is a method for making a fragranced glove, comprising the steps of: providing a glove with an inside surface and an outside surface, applying a fragrance to the glove, tumbling the glove to evenly distribute the fragrance, and drying the glove to remove the residual fragrance.

In a second embodiment, the method for making a fragranced glove comprises the steps of: halogenating the cured glove, neutralizing and rinsing the halogenated glove; drying the rinsed glove; applying a fragrance to an exterior surface of the rinsed and dried glove; and then tumble drying the glove. Preferably, fragrance is added when the glove is rinsed. Also, preferably, the glove is drained after neutralizing and rinsing but before drying.

In a third embodiment, the glove is on a mold where the inside surface of the glove is exposed to the environment. The method includes spraying or misting fragrance onto the inside surface of the glove; stripping the glove from the mold so that the exterior surface of the glove is in its proper position; halogenating the glove; neutralizing and rinsing the halogenated glove; and then drying the glove. Preferably, the glove is drained after the glove has been neutralized and rinsed.

DETAILED DESCRIPTION OF THE INVENTION

Figure 2:
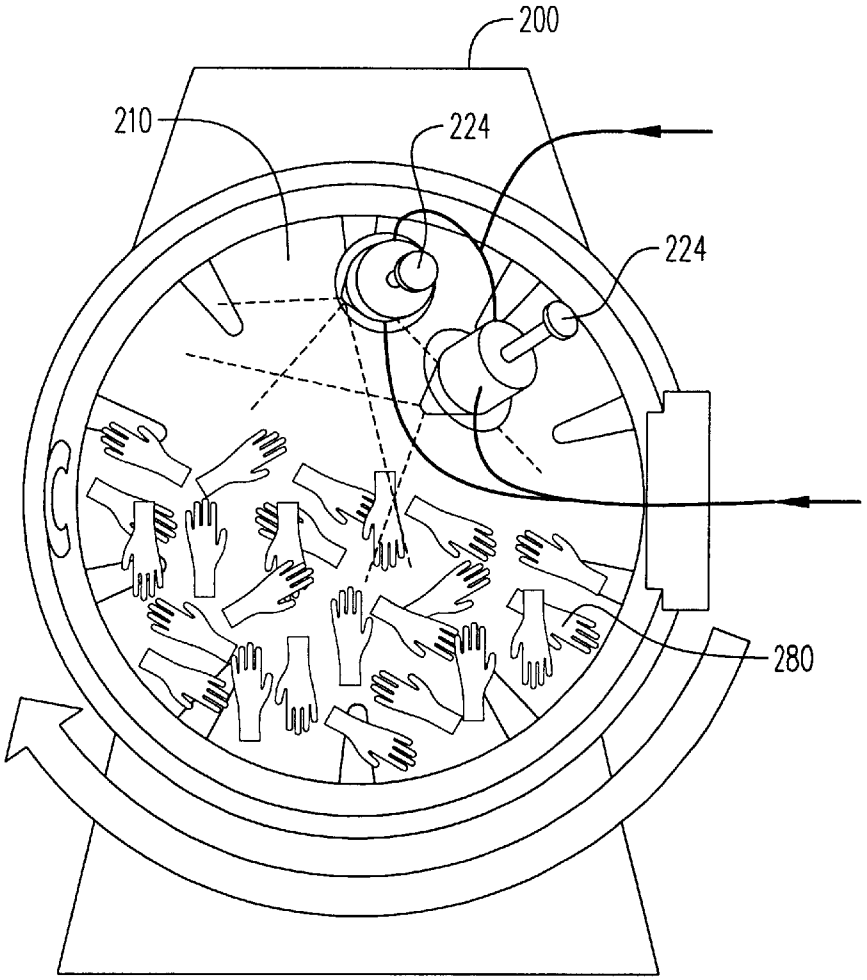
FIG. 2 is a front view of the coating apparatus of FIG. 1.
Figure 1:
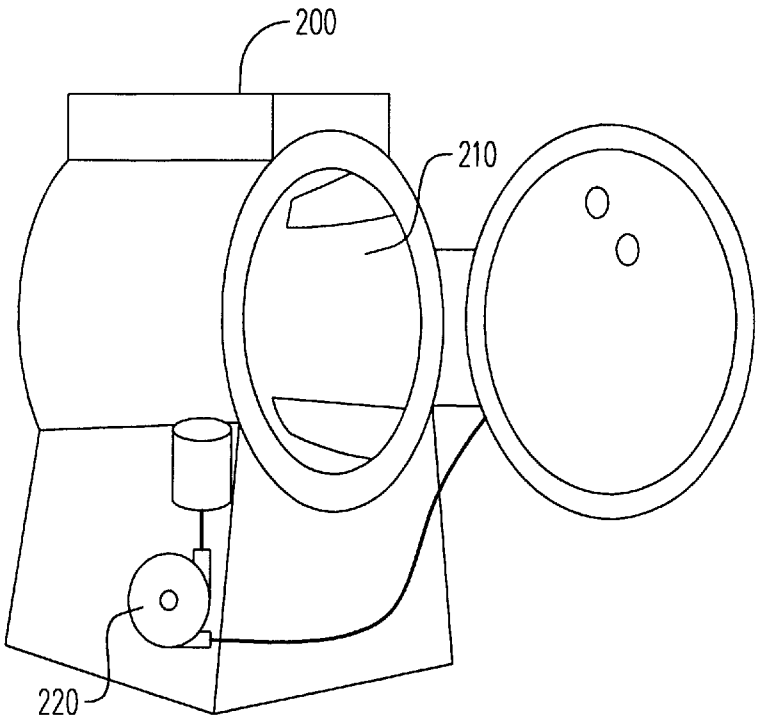
FIG. 1 is a perspective view of a coating apparatus that is used in the present invention.
Figure 3:
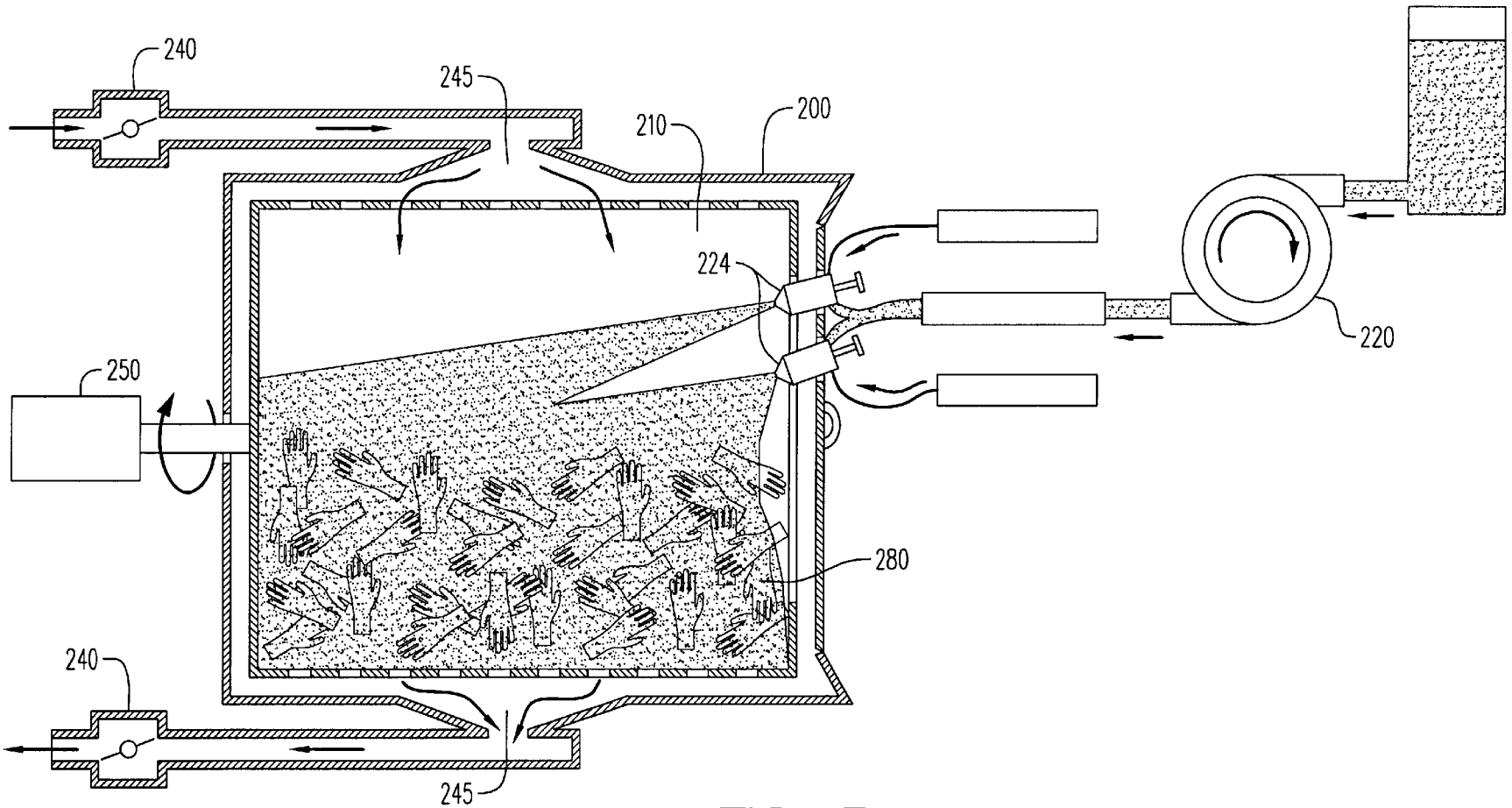
FIG. 3 is a side view of the coating apparatus of FIG. 1.

FIGS. 1, 2, and 3, show coating apparatus 200, which is used in the preferred embodiment of the present invention. Coating apparatus 200 is used to apply and preferably spread the fragrance evenly over a glove 280, and dry the residual fragrance from the glove. It should be understood that the fragrance can be applied as a fragrance or as a fragrance solution. Coating apparatus 200 has a rotating drum 210, a metering pump 220, and one or more air vent dampers 240.

A metered dose of a fragrance solution that includes perfume, water, and an emulsifying agent is applied onto glove 280 using coating apparatus 200. The water acts as a carrier of the perfume and the emulsifying agent creates an emulsion between the perfume and the water. The fragrance solution is formulated to enable a sufficient amount of the fragrance to be distributed evenly over glove 280 and the dosage is determined by the weight of the gloves added to drum 210.

The emulsifying agent included in the fragrance solution can be, but is not limited to, sodium lauryl sulfate, alkylphenol-hydroxypolyoxyethylene, polysorbates, and mixtures thereof. Moreover, a water based emulsion may be used.

The fragrance solution may include about 5 wt. % to about 20 wt. % perfume, about 1 wt. % to about 5 wt. % emulsifying agent, and about 75 wt. % to about 94 wt. % water.

Glove 280 along with other gloves is placed in drum 210 of coating apparatus 200. Drum 210 rotates at a speed, which enables glove 280 to tumble about. A speed control drive unit 250 may be used to adjust the speed of drum 210. Preferably, drum 210 rotates at a speed such that the gloves remain in the bottom half of drum 210 to permit the spray to reach across the drum.

In FIG. 3, metering pump 220 moves the fragrance solution into and through one or more spray nozzles 224 to evenly spray or mist the fragrance solution into drum 210. Pump 220 is operated to deliver the proper amount of fragrance solution. The fragrance solution is applied onto glove 280 either by direct contact on the glove or by transference, whereby gloves rub against one another to spread the fragrance. Regardless, as drum 210 slowly rotates, glove 280 is coated with the fragrance. The tumbling action also ensures that the fragrance is evenly applied over glove 280.

Air 245 is introduced into drum 210 to dry glove 280. Air vent damper 240 controls the airflow by adjusting the amount of air 245 that passes through. For example, air vent damper 240 is closed when applying the fragrance solution, to prevent it from escaping through the air ducts. When drying, air vent damper 240 is opened to allow air 245 to pass through and dry glove 280. During this phase, the rotation speed of drum 210 is increased to get the gloves to become airborne, further facilitating the drying process.

Figure 4:
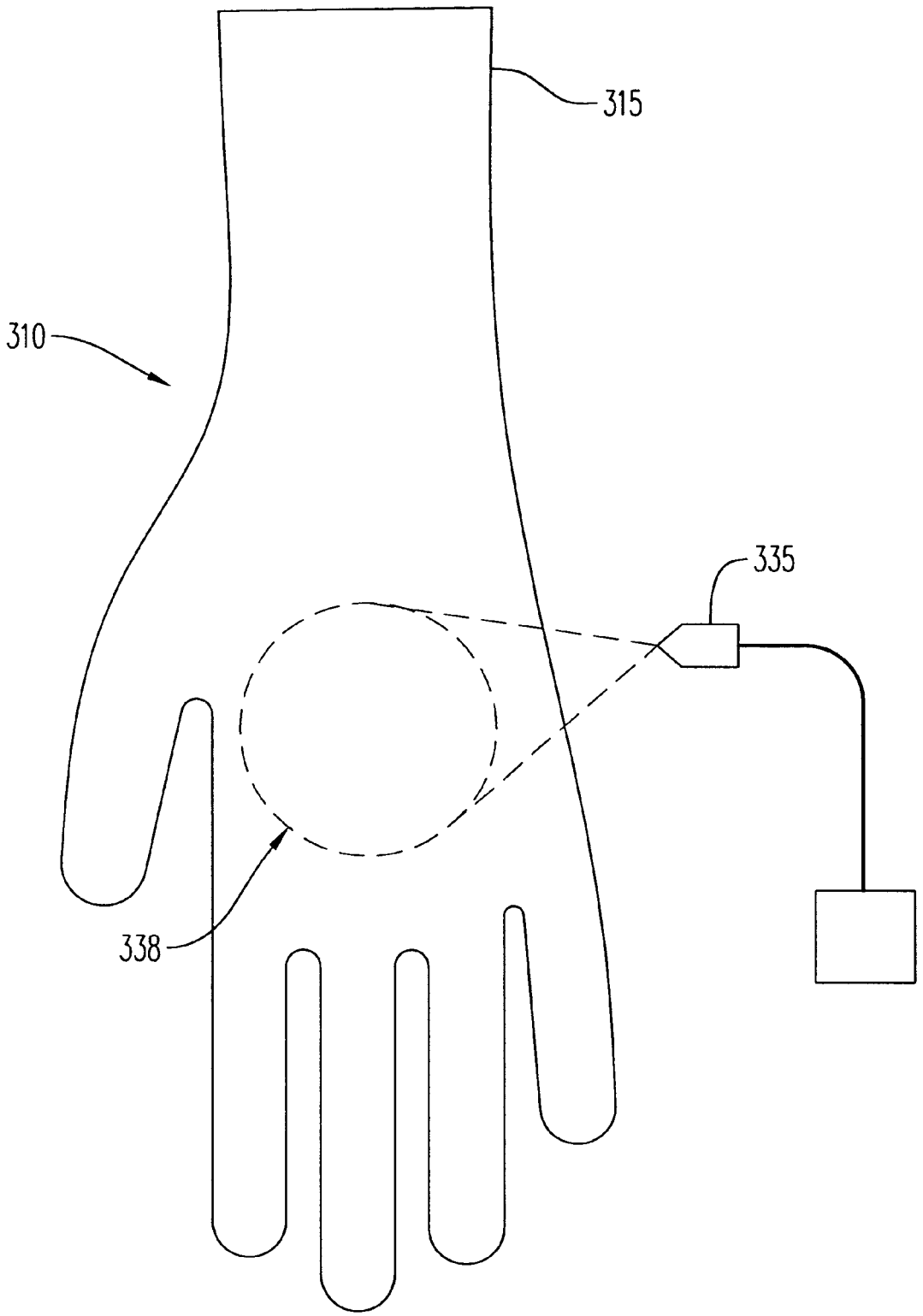
FIG. 4 is an elevation view of a glove of the present invention on a former.

In FIG. 4, there is provided a formed glove 310. The formed glove 310 has been cured. The glove 310 has an inside or interior surface 315 and an outside or exterior surface (not shown).

Figure 5:
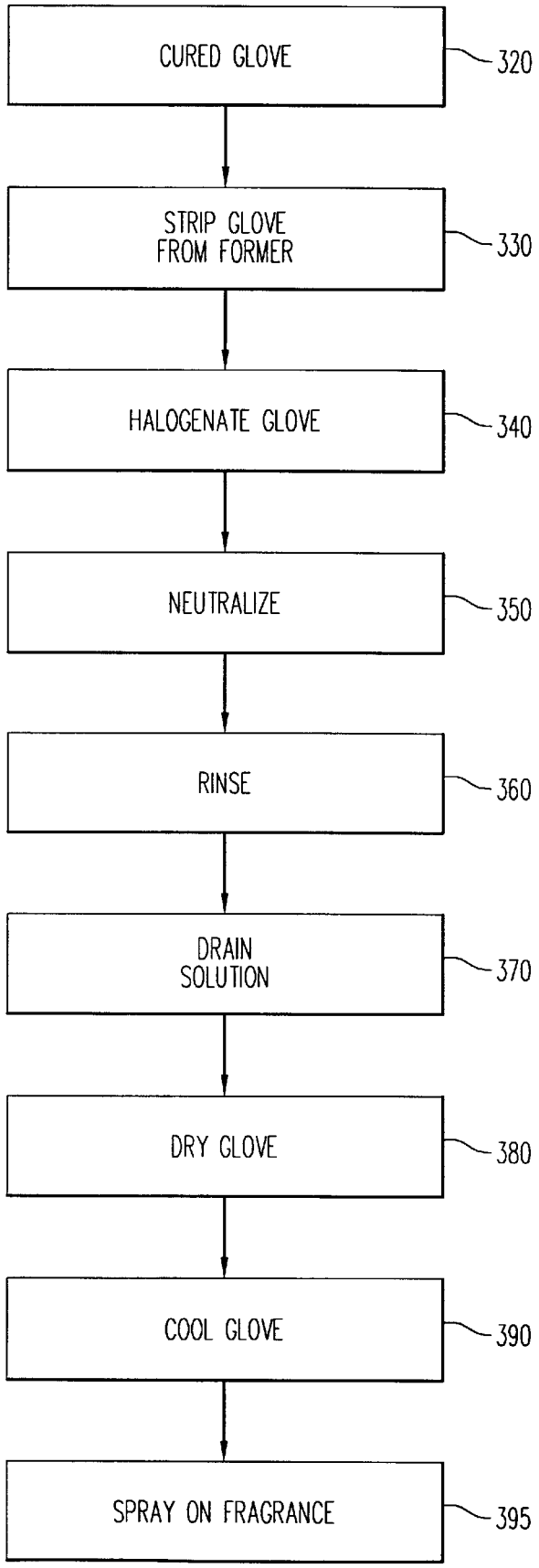
FIG. 5 is a flow diagram of a first embodiment of the method of the present invention.

In the embodiment shown in FIG. 5, glove 310 is fragranced by a method of the present invention. The glove 310 is already formed and cured as shown by step 320. The glove 310 is stripped from a mold or glove former, as discussed in step 330, so that the exterior surface is in its proper exterior position.

The glove 310 is then halogenated in a halogenation solution as discussed at step 340. The preferred halogenation solution is a chlorine solution. Thereafter, the halogenated glove 310 is preferably neutralized (step 350) and then rinsed (step 360). It is then preferable that glove 310 is drained as shown in step 370. In a most preferred embodiment of the embodiment depicted in FIG. 5, fragrance is added to the rinse so that fragrance is applied to both inside surface 315 and the outside surface of the glove. The neutralized glove 310 is then rinsed as shown in step 360.

In a preferred embodiment, glove 310 is dried, step 380, by conventional devices, such as, for example, a dryer. At step 395, fragrance is applied to the exterior surface of glove 310 by spraying or misting, and the glove is then tumbled and dried.

The step of stripping glove 310 from a mold is used to reverse the surface orientation of the glove. That is, the stripping process changes the surface orientation so that the outside surface is the exterior surface and is exposed to the environment, while inside surface 315, shown in FIG. 4, becomes the interior surface of glove 310 and, thus, is no longer directly exposed to the environment.

Halogenation, step 340, is a treatment where glove 310 is dipped or placed in a solution that has a halogen, such as chlorine or bromine. Preferably, chlorine is used as the halogen. This treatment imparts a slippery feel to inside surface 315 and the outside surface, so that glove 310 can slide onto the user's hand with less resistance.

As stated above, a rinsing step 360 may also be incorporated into the method. In the rinsing step, glove 310 is placed in the rinse solution for cleaning. Most preferably, fragrance is added to the rinse solution, thereby providing an initial coating of the fragrance on glove 310 during the rinsing step.

As also stated above, glove 310 may also be neutralized, step 350, after halogenation, but before rinsing and/or the fragrance application step. Neutralization removes halogens from inside surface 315 and the outside surface of glove 310. Typically, neutralization is performed by immersing glove 310 in a neutralizing solution, for example an alkaline solution may be used.

The drying step 380 is any conventional drying that includes, for example, an air blower being applied for a discrete period of time in proximity to glove 310. Drying will remove the residual rinsing solution from glove 310.

The present invention may include a cooling step 390 that lowers the glove temperature after drying glove 310. For example, the glove temperature may be cooled to about room temperature. In this cooling step, additional fragrance is applied onto glove 310 and the glove is tumbled. The tumbling is used to evenly coat glove 310 with fragrance. For example, glove 310 is placed in rotating drum 210 with other gloves. The rotating action tumbles glove 310 and other individual gloves around the chamber. In addition, the tumbling action leads to rubbing of individual gloves against one another. This facilitates the spreading of fragrance evenly across glove 310.

Figure 6:
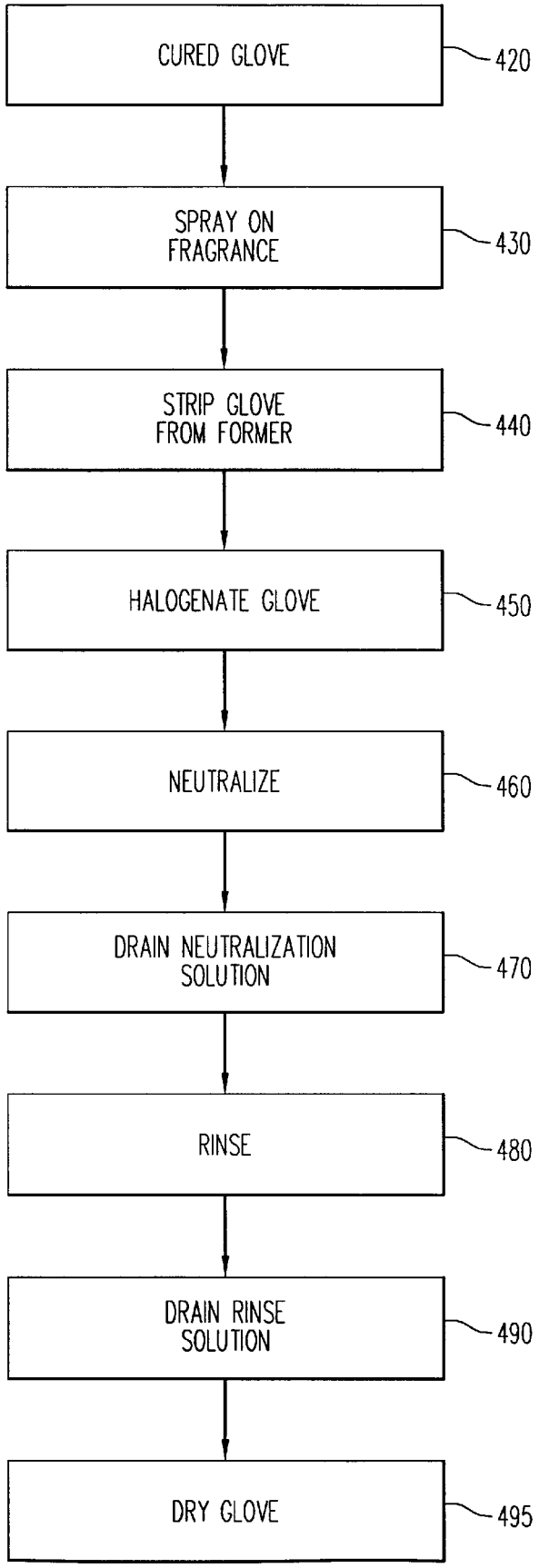
FIG. 6 is a flow diagram of a second embodiment of the method of the present invention.

In an alternative embodiment shown in FIG. 6, glove 310 is formed and cured, as shown in step 420. The glove 310 is positioned on the mold, with inside surface 315 exposed to the environment and the outside surface in contact or positioned on the mold. Fragrance is applied, step 430, to inside surface 315, preferably by spraying or misting. Most preferably, the spraying or misting is with a spray nozzle 335 shown in FIG. 4. The spray preferably forms a desired spray pattern 338 in the palm of glove 310. However, the spray pattern can be any desired pattern. Also, although not preferred, fragrance can be sprayed on the entire inside surface of glove 310.

After fragrance is sprayed or misted onto glove 310, the glove is stripped, step 440, from the mold.

The glove 310 may be halogenated, step 450, after stripping the glove from the mold. If halogenated, glove 310 is preferably neutralized 460 and then drained 470. Next, glove 310 is rinsed 480 in a rinse solution and then drained 490. Whether drained or not, glove 310 is next dried, step 495.

In this embodiment, halogenation is preferably with chlorine. Also, as with the embodiment of FIG. 5, fragrance may be added to the rinse solution so that when glove 310 is rinsed, step 480, fragrance is transferred onto both inside surface 315 and the outside surface of the glove.

The glove 310 may be dried in any conventional manner including, applying an air blower for a discrete period of time in proximity to glove 310. This drying removes the residual neutralizing and rinsing solutions from glove 310. Also, glove 310 may be cooled. For example, glove 310 may be cooled to about room temperature. Still optionally, glove 310 may be tumbled after fragrance is applied. Furthermore, the tumbling may be incorporated into the drying step.

The present invention has been described with particular reference to the preferred forms thereof. It will be obvious to one of ordinary skill in the art that changes and modifications may be made therein without departing from the spirit and scope of the present invention as defined by the following claims.

What is claimed is:

1. A method for making a fragranced glove, comprising the steps of:

providing a cured glove with an inside surface and an outside surface;

applying a fragrance to said glove;

tumbling said glove to distribute virtually evenly the fragrance; and drying said glove to remove any residual fragrance.

2. The method of claim 1, wherein the fragrance is applied to said glove by spraying or misting the fragrance on said glove.

3. The method of claim 1, wherein the fragrance is applied as a fragrance solution.

4. The method of claim 3, wherein said fragrance solution comprises perfume, water, and an emulsifying agent.

5. The method of claim 4, wherein said emulsifying agent is selected from the group consisting of sodium lauryl sulfate, alkylphenol-hydroxypolyoxyethylene, polysorbates, and mixtures thereof.

6. The method of claim 3, wherein said fragrance solution is about 5 wt. % to about 20 wt. % perfume, about 1 wt. % to about 5 wt. % emulsifying agent, and about 75 wt. % to about 94 wt. % water.

7. A method for making a fragranced glove, comprising the steps of:

(a) providing a cured glove having an inside surface and an outside surface each in their proper position;

(b) halogenating said glove;

(c) rinsing said halogenated glove in a rinse solution;

(d) drying said rinsed glove; and (e) applying a fragrance on said glove.

8. The method of claim 7, wherein the fragrance is applied to said glove by spraying or misting the fragrance on said glove.

9. The method of claim 7, further comprising the step of neutralizing said glove, after halogenating.

10. The method of claim 7, wherein the rinse solution has fragrance thereby applying fragrance to said glove.

11. The method of claim 7, further comprising the step of cooling said glove to about room temperature, after applying fragrance to said glove.

12. The method of claim 7, further comprising tumbling said glove, during the step of applying fragrance to said glove, to distribute evenly the fragrance to the outside surface of said glove.

13. The method of claim 7, further comprising tumbling said glove, after the step of applying fragrance to said glove, to distribute evenly the fragrance to the outside surface of said glove.

14. The method of claim 7, wherein said halogenating is performed with chlorine.

15. A method for making a fragranced glove, comprising the steps of:

providing a cured glove with an inside surface and an outside surface on a mold so that the outside surface contacts the mold and the inside surface is exposed to an environment;

applying a fragrance to the inside surface of said glove;

stripping said glove from the mold so that the outside surface is exposed to the environment;

neutralizing and rinsing said stripped glove; and drying said neutralized and rinsed glove.

16. The method of claim 15, further comprising halogenating said glove, after stripping.

17. The method of claim 16, wherein said halogenating is performed with chlorine.

18. The method of claim 16, wherein halogenating said glove includes halogenating in a halogen solution.

19. The method of claim 16, further comprising draining said glove after halogenating.

20. The method of claim 15, wherein the rinsing step includes placing said glove in a rinse solution.

21. The method of claim 15, further comprising draining said glove, after neutralizing.

* * * * *